US005743922A

United States Patent [19]

Peter-Hoblyn et al.

[11] Patent Number: 5,743,922

[45] Date of Patent: *Apr. 28, 1998

[54] ENHANCED LUBRICITY DIESEL FUEL EMULSIONS FOR REDUCTION OF NITROGEN OXIDES

[75] Inventors: Jeremy D. Peter-Hoblyn, Bodwin, Great Britain; James M. Valentine, Fairfield, Conn.; Leonard Dubin, Skokie, Ill.

[73] Assignee: Nalco Fuel Tech, Naperville, Ill.

[ * ] Notice: The term of this patent shall not extend beyond the expiration date of Pat. No. 5,284,492.

[21] Appl. No.: 215,504

[22] Filed: Mar. 21, 1994

Related U.S. Application Data

[63] Continuation-in-part of Ser. No. 918,679, Jul. 22, 1992, abandoned.

[51] Int. Cl.[6] ..... C10L 1/18

[52] U.S. Cl. ..... 44/301; 44/302

[58] Field of Search ..... 55/301, 302

[56] References Cited

U.S. PATENT DOCUMENTS

| | | | |
|---|---|---|---|
| 3,180,832 | 4/1965 | Furey | 252/56 |
| 3,281,358 | 10/1966 | Furey | 252/34 |
| 3,281,438 | 10/1966 | Johnson | 260/404 |
| 3,287,273 | 11/1966 | Furey et al. | 252/56 |
| 3,321,404 | 5/1967 | Furey et al. | 252/51.5 |
| 3,390,083 | 6/1968 | Rosen | 252/33.4 |
| 3,399,145 | 8/1968 | Martinek et al. | 252/309 |
| 3,429,817 | 2/1969 | Furey et al. | 252/56 |
| 3,490,237 | 1/1970 | Lissant | 60/217 |
| 3,637,357 | 1/1972 | Nixon et al. | 44/51 |
| 3,932,476 | 1/1976 | Bergeron | 260/404 |
| 4,017,522 | 4/1977 | Bailey et al. | 260/347 |
| 4,083,698 | 4/1978 | Wenzel et al. | 44/51 |
| 4,162,143 | 7/1979 | Yount | 44/51 |
| 4,173,455 | 11/1979 | Fodor et al. | 44/51 |
| 4,182,614 | 1/1980 | Moriyama et al. | 44/51 |
| 4,199,326 | 4/1980 | Fung | 44/51 |
| 4,297,107 | 10/1981 | Boehmke | 44/51 |
| 4,378,230 | 3/1983 | Rhee | 44/51 |
| 4,382,802 | 5/1983 | Beinke et al. | 44/51 |
| 4,392,865 | 7/1983 | Grosse et al. | 44/51 |
| 4,666,457 | 5/1987 | Hayes et al. | 44/51 |
| 4,696,638 | 9/1987 | DenHerder | 431/4 |
| 4,725,287 | 2/1988 | Gregoli et al. | 44/51 |
| 4,770,670 | 9/1988 | Hazbun et al. | 44/51 |
| 4,842,616 | 6/1989 | Verhille | 44/51 |
| 5,000,757 | 3/1991 | Puttock et al. | 44/301 |
| 5,284,492 | 2/1994 | Dubin | 44/301 |
| 5,344,306 | 9/1994 | Brown et al. | 44/301 |

FOREIGN PATENT DOCUMENTS

0475620A2 8/1991 European Pat. Off. .

OTHER PUBLICATIONS

"Specialty Chemicals For Worldwide Applications", PPG Mazer, AmericanChemical Date Unavailable.

"Diesel Engine NOx Control; Selective Catalytic Reduction and MethanolEmulsion" John H. Wasser, Richard B. Perry EPRI/EPA Joint Symposium On Stationary NOx Control, New Orleans, LA, Mar. 1987.

"Control of NOx Emissions From Distillate Oil–Fired Gas Turbines", D.T. Dainoff, S. Alexander; 1991 ASME Cogen–Turbo V., Budapest, Hungary, Sep. 3–5, 1991.

GAF, EGEPAL RC–520; "Low–Foaming, Oil–Soluble Nonionic Surfactant" Technical Bulletin 2203–010 date unavailable.

Scher, Technical Bulletin; "Schercomid SO–A"; Bulletin #307–2, Sep. 1983.

Scher, Technical Bulletin; "Schercomid ODA"; Bulletin #331–1, Aug., 1983.

*Primary Examiner*—Jacqueline V. Howard

*Attorney, Agent, or Firm*—St. Onge Steward Johnston & Reens LLC

[57] ABSTRACT

An improved lubricity water and diesel fuel emulsion is presented. The emulsion is used as fuel for diesel engines, and includes a lubricity additive selected from the group consisting of dimer acids, trimer acids, phosphate esters, sulfurized castor oil, and mixtures thereof.

20 Claims, 1 Drawing Sheet

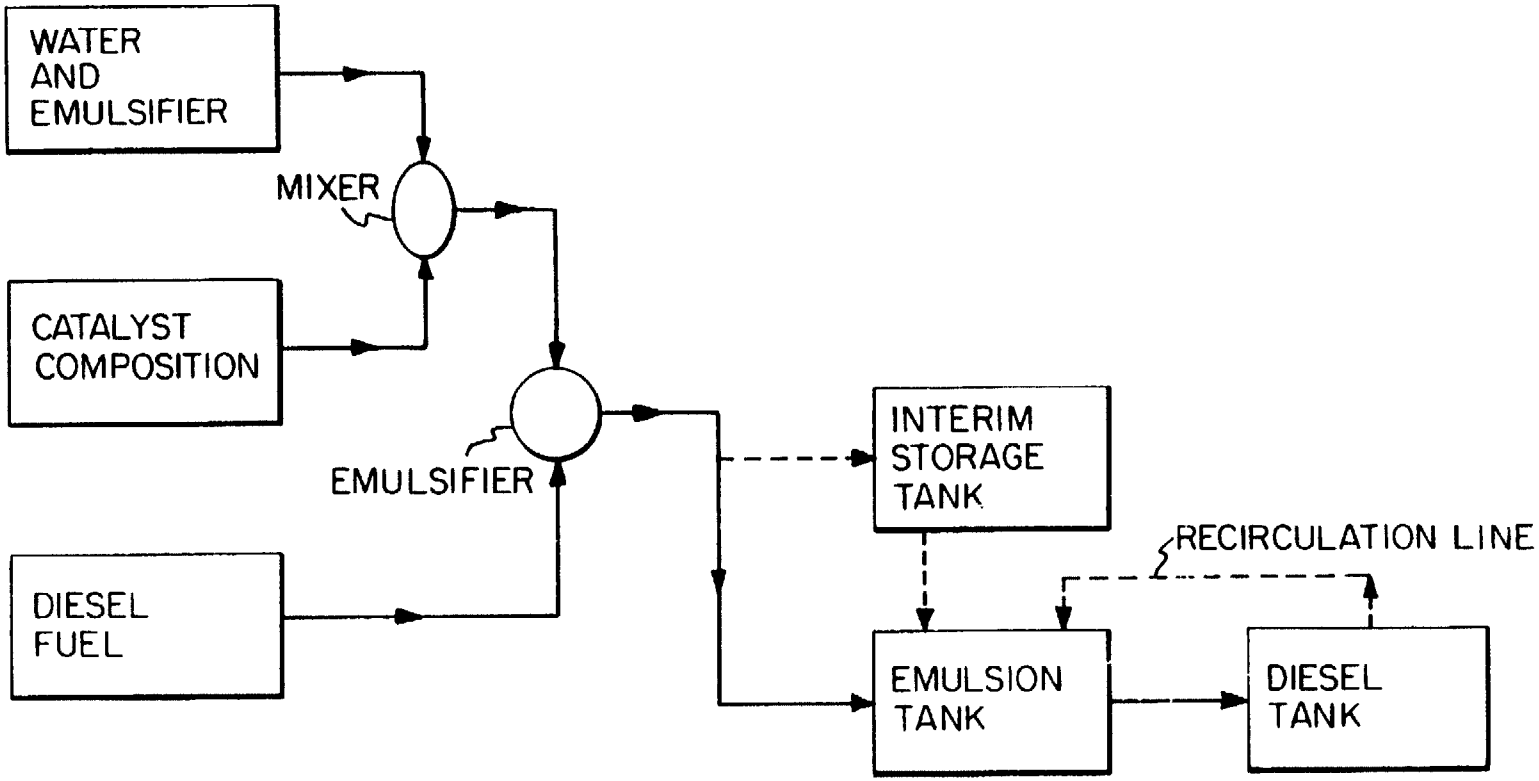
WATER AND EMULSIFIER
CATALYST COMPOSITION
DIESEL FUEL
MIXER
EMULSIFIER
INTERIM STORAGE TANK
EMULSION TANK
RECIRCULATION LINE
DIESEL TANK

ENHANCED LUBRICITY DIESEL FUEL EMULSIONS FOR REDUCTION OF NITROGEN OXIDES

RELATED APPLICATION

This application is a continuation-in-part of U.S. Patent Application entitled "The Reduction of Nitrogen Oxides Emissions from Vehicular Diesel Engines" Ser. No. 07/918,679, filed in the name of Valentine on Jul. 22, 1992, now abandoned, the disclosure of which is incorporated herein by reference.

TECHNICAL FIELD

The present invention relates to a fuel oil composition comprising an emulsion of water and diesel fuel which is used as a combustion fuel for a diesel engine. More particularly, the present invention relates to lubricity agents which can be incorporated in the noted emulsion to permit operation of the engine when firing a water and fuel oil emulsion.

One significant drawback to the use of diesel-fueled vehicles, including trucks, buses, passenger vehicles, locomotives, off-road vehicles, etc. (as opposed to gasoline-powered vehicles) is caused by their relatively high flame temperatures during combustion, which can be as high as 2200° F. and higher. Under such conditions there is a tendency for the production of thermal $NO_x$ in the engine, the temperatures being so high that free radicals of oxygen and nitrogen are formed and chemically combine as nitrogen oxides. In fact, $NO_x$ can also be formed as a result of the oxidation of nitrogenated species in the fuel.

Nitrogen oxides comprise a major irritant in smog and are believed to contribute to tropospheric ozone which is a known threat to health. In addition, nitrogen oxides can undergo photochemical smog formation through a series of reactions in the presence of sunlight and hydrocarbons. Furthermore, they have been implicated as a significant contributor to acid rain and are believed to augment the undesirable warming of the atmosphere which is generally referred to as the "greenhouse effect."

Methods for the reduction of $NO_x$ emissions from diesel engines which have previously been suggested, include the use of catalytic converters, engine timing changes, exhaust gas recirculation, and the combustion of "clean" fuels, such as methanol and natural gas. Unfortunately, the first three would be difficult to implement because of the effort required to retrofit existing engines. In addition, they may cause increases in unburned hydrocarbons and particulate emissions to the atmosphere. Although the use of clean fuels do not have such drawbacks, they require major changes in a vehicle's fuel system, as well as major infrastructure changes for the production, distribution, and storage of such fuels.

It has been found that combusting a water and diesel fuel emulsion in a diesel engine as a way to reduce nitrogen oxide emissions can lead to mechanical problems. These problems are usually caused by the fact that the components of the engine are designed to operate within the lubricity characteristics of diesel fuel. Since a water and diesel fuel emulsion has lubricity far less than that of diesel fuel, a great deal of damage to the diesel engine components can be caused by combusting a water and fuel oil emulsion in the engine. Although this problem is apparent in virtually all diesel engines, it is especially significant for engines having aluminum parts which are more sensitive to damage in this way than steel, especially stainless steel, parts.

What is desired, therefore, is a method and composition which can achieve significant reductions in the $NO_x$ emissions from diesel engines without requiring substantial retrofitting of the engines, nor an increase in emissions of other pollutants. The method and composition selected should be capable of being instituted on a commercial level without significant infrastructure changes.

BACKGROUND ART

Researchers have considered the use of water-in-oil emulsions for improving combustion efficiency in diesel engines. For instance, DenHerder, in U.S. Pat. No. 4,696,638, discusses such emulsions and indicates that the positive effects therefrom include "cleaner exhaust." Although the disclosure of DenHerder refers to emulsions containing up to about 40% water, DenHerder is primarily directed to emulsions having only up to about 10% water in the form of droplets having a diameter of about 1 to about 10 microns.

Furthermore, in "Diesel Engine $NO_x$ Control: Selective Catalytic Reduction and Methanol Emission," EPRI/EPA Joint Symposium on Stationary $NO_x$ Control, New Orleans, La., March, 1987, Wasser and Perry have reported that $NO_x$ reductions of up to 80%, which are the levels desired for effective emission control, can be achieved in diesel engines using water and oil emulsions. They found, though, that emulsions of at least 60% water-in-oil are necessary to achieve such reductions. Unfortunately, such high water ratios can lead to increased emissions of carbon monoxide (CO) and unburned hydrocarbons. In addition, such high water levels can also create problems in emulsion stability and create corrosion and storage volume concerns.

DISCLOSURE OF INVENTION

The present invention relates to a process for reducing $NO_x$ emissions from diesel engines, and involves the formation of an emulsion of water in diesel fuel at a water to fuel ratio of up to about 70% by weight, wherein the emulsion contains a lubricity agent. The invention then involves the combustion of the emulsion in a diesel engine.

BRIEF DESCRIPTION OF THE DRAWING

The present invention will be understood and its advantages more apparent in view of the following detailed description, especially when read with reference to the appended drawing which comprises a schematic illustration of a diesel engine fuel system according to the present invention.

DETAILED DESCRIPTION OF THE PREFERRED EMBODIMENT

The present invention relates to an enhanced lubricity water and diesel fuel emulsion for reducing nitrogen oxides emissions and improving combustion efficiency in a diesel engine. In particular, this invention relates to a water and diesel fuel emulsion comprising an agent which provides lubricity to the emulsion comparable to that of diesel fuel alone. The subject emulsion can be either a water in diesel fuel or a diesel fuel in water emulsion, although water in fuel oil emulsions are generally preferred for most applications, and can be used as the fuel for a diesel engine.

The oil phase in the inventive emulsion comprises what is conventionally known as diesel fuel, as defined by the American Society of Testing and Management (ASTM) Standard Specification for Fuel Oils (designation: D 396-86). For the purposes of this description, diesel fuels are defined as fuel oil number 2 petroleum distillates of volatility and cetane number characteristics effective for the purpose of fueling internal combustion diesel engines.

The water which is used to form the emulsion is preferably demineralized water. Although demineralized water is not required for the successful control of nitrogen oxides, it is preferred in order to avoid the deposit of minerals from the water on the internal surfaces of the diesel engine fuel system through which the inventive emulsion flows. In this way, engine life is extended and maintenance and repair time significantly reduced.

The emulsion preferably comprises up to about 70% water, more preferably about 5% to about 70% water-in-diesel fuel. Most preferably, the emulsion comprises about 15% to about 45% water in diesel fuel. The emulsion can be prepared by passing water and the diesel fuel through a mechanical emulsifying device which can be provided on site or within the fuel system of the diesel vehicle. After being emulsified, the subject emulsion can be stored in an appropriate storage unit or tank prior to combustion or supplied directly to a diesel engine as output from the emulsifier.

In an advantageous aspect of the invention, the emulsion is formed at a fueling station, especially at the fuel pump, where water and fuel are emulsified and then immediately pumped into the vehicle. In this way, emulsion storage and stability concerns are greatly reduced.

Although this description is written in terms of water-in-fuel oil emulsions, it will be understood to include both fuel oil-in-water and water-in-fuel oil emulsions since they are believed to be equally effective. Moreover, inversion from one to the other may readily occur, so it is not always clear which form of emulsion is present at any given time.

The inventive emulsions are prepared such that the discontinuous phase preferably has a particle size wherein at least about 70% of the droplets are below about 5 microns Sauter mean diameter. More preferably, at least about 85%, and most preferably at least about 90%, of the droplets are below about 5 microns Sauter mean diameter for emulsion stability.

Emulsion stability is largely related to droplet size. The primary driving force for emulsion separation is the large energy associated with placing oil molecules in close proximity to water molecules in the form of small droplets. Emulsion breakdown depends on how quickly droplets coalesce. Emulsion stability can be enhanced by the use of surfactants and the like, which act as emulsifiers or emulsion stabilizers. These generally work by forming repulsive layers between droplets, prohibiting coalescence.

The gravitational driving force for phase separation is much more prominent for large droplets, so emulsions containing large droplets separate most rapidly. Smaller droplets also settle, but can be less prone to coalescence, which is the cause of creaming. If droplets are sufficiently small, the force of gravity acting on the droplet is small compared to thermal fluctuations or subtle mechanical agitation forces. In this case the emulsion can become stable almost indefinitely, although given a long enough period of time or a combination of thermal fluctuations these emulsions will eventually separate.

Although it is possible to emulsify the water and diesel oil and inject directly into the fuel tank, or even the combustion cylinder of the vehicle, generally it is required that water and diesel oil emulsions exhibit a high degree of stability. To avoid separation of the emulsion, which can cause slugs of water to be injected through the burner nozzle leading to combustion problems and possible engine damage, an emulsification system is most preferably employed to maintain the emulsion.

Because the inventive emulsion may have to sit stagnant in storage, for instance, when used as a fuel source for highway vehicles where it is pumped into a holding tank from which limited amounts are pumped out for the vehicles, it may be necessary to include a component effective for maintaining the stability of the emulsion such as a surfactant. In fact, sufficient stabilizing component may be needed to provide stability for up to about six months in the case of use for highway vehicles. Even where shorter fuel residence times are encountered, such as by captive fueled city buses or delivery vehicles, emulsion stability for one week or greater may still be necessary.

In a European Patent Application having Publication No. 0 475 620 A2, Smith, Bock, Robbins, Pace, and Grimes disclose an emulsifier blend which they describe as effective at emulsifying a water-in-diesel fuel emulsion. The disclosed blend comprises a hydrophilic surfactant such as alkyl carboxylic and alkylaryl sulfonic acid salts and ethoxylated alkyl phenols, and a lipophilic surfactant such as ethoxylated alkyl phenols and alkyl and alkylaryl sulfonic acid salts. The emulsifier blends can also include cosurfactants and polar organic solvents. The disclosure of the Smith et al. European application is incorporated herein by reference.

Another desirable emulsification system which can be utilized comprises about 25% to about 85% by weight of an amide, especially an alkanolamide or n-substituted alkyl amine; about 5% to about 25% by weight of a phenolic surfactant; and about 0% to about 40% by weight of a difunctional block polymer terminating in a primary hydroxyl group. More preferably, the amide comprises about 45% to about 65% of the emulsification system; the phenolic surfactant about 5% to about 15%; and the difunctional block polymer about 30% to about 40% of the emulsification system.

Suitable n-substituted alkyl amines and alkanolamides which can function to stabilize the emulsion of the present invention are those formed by the condensation of, respectively, an alkyl amine and an organic acid or a hydroxyalkyl amine and an organic acid, which is preferably of a length normally associated with fatty acids. They can be mono-, di-, or triethanolamines and include any one or more of the following: oleic diethanolamide, cocamide diethanolamine (DEA), lauramide DEA, polyoxyethylene (POE) cocamide, cocamide monoethanolamine (MEA), POE lauramide DEA, oleamide DEA, linoleamide DEA, stearamide MEA, and oleic triethanolamine, as well as mixtures thereof. Such alkanolamides are commercially available, including those under trade names such as Clindrol 100-0, from Clintwood Chemical Company of Chicago, Ill.; Schercomid ODA, from Scher Chemicals, Inc. of Clifton, N.J.; Schercomid SO-A, also from Scher Chemicals, Inc.; Mazamide®, and the Mazamide series from PPG-Mazer Products Corp. of Gurnee, Ill.; the Mackamide series from McIntyre Group, Inc. of University Park, Ill.; and the Witcamide series from Witco Chemical Co. of Houston, Tex.

The phenolic surfactant is preferably an ethoxylated alkyl phenol such as an ethoxylated nonylphenol or octylphenol. Especially preferred is ethylene oxide nonylphenol, which is available commercially under the tradename Triton N from Union Carbide Corporation of Danbury, Conn. and Igepal CO from Rhone-Poulenc Company of Wilmington, Del.

The block polymer which is an optional element of the emulsification system advantageously comprises a nonionic, difunctional block polymer which terminates in a primary hydroxyl group and has a molecular weight ranging from about 1,000 to above about 15,000. Such polymers are generally considered to be polyoxyalkylene derivatives of propylene glycol and are commercially available under the tradename Pluronic from BASF-Wyandotte Company of Wyandotte, N.J. Preferred among these polymers are propylene oxide/ethylene oxide block polymers commercially available as Pluronic 17R1.

Desirably, the emulsification system should be present at a level which will ensure effective emulsification. Preferably, the emulsification system is present at a level of at least about 0.05% by weight of the emulsion to do so. Although there is no true upper limit to the amount of the emulsification system which is present, with higher levels leading to greater emulsification and for longer periods, there is generally no need for more than about 5.0% by weight, nor, in fact, more than about 3.0% by weight.

It is also possible to utilize a physical emulsion stabilizer in combination with the emulsification system noted above to maximize the stability of the emulsion. Use of physical stabilizers also provides economic benefits due to their relatively low cost. Although not wishing to be bound by any theory, it is believed that physical stabilizers increase emulsion stability by increasing the viscosity of immiscible phases such that separation of the oil/water interface is retarded. Exemplary of suitable physical stabilizers are waxes, cellulose products, and gums such as whalen gum and xanthan gum.

When utilizing both the emulsification system and physical emulsion stabilizers, the physical stabilizer is present in an amount of about 0.05% to about 5% by weight of the combination of chemical emulsifier and the physical stabilizer. The resulting combination emulsifier/stabilizer can then be used at the same levels noted above for the use of the emulsification system.

The emulsion used in the process of the present invention can be formed using a suitable mechanical emulsifying apparatus which would be familiar to the skilled artisan. Advantageously, the apparatus is an in-line emulsifying device for most efficiency. The emulsion is formed by feeding both the water and the diesel fuel in the desired proportions to the emulsifying apparatus, and the emulsification system can either be admixed or dispersed into one or both of the components before emulsification or can be added to the emulsion after it is formed.

It has now surprisingly been found that the addition of a component selected from the group consisting of dimer and/or trimer acids, sulfurized castor oil, phosphate esters, and mixtures thereof will significantly increase the lubricity of the subject water and diesel fuel emulsions and avoid the mechanical problems associated with such emulsions when combusted in a gas turbine. Most preferred among these are the dimer and/or trimer acids or blends thereof.

Dimer acids are high molecular weight dibasic acids produced by the dimerization of unsaturated fatty acids at mid-molecule and usually contain 21–36 carbons. Similarly, trimer acids contain three carboxyl groups and usually 54 carbons. Dimer and trimer acids are generally made by a Diels Alder reaction. This usually involves the reaction of an unsaturated fatty acid with another polyunsaturated fatty acid—typically linoleic acid. Starting raw materials usually include tall oil fatty acids. In addition, it is also known to form dimer and trimer acids by reacting acrylic acid with polyunsaturated fatty acids.

After the reaction, the product usually comprises a small amount of monomer units, dimer acid, trimer acid, and higher analogs. Where the product desired is primarily dimer acid (i.e., at least about 85% dimer acid), the reactant product is often merely referred to as dimer acid. However, the individual components can be separated to provide a more pure form of dimer acid or trimer acid by itself.

Suitable dimer acids for use in this invention include Westvaco Diacid 1550, commercially available from Westvaco Chemicals of Charleston Heights, S.C.; Unidyme 12 and Unidyme 14, commercially available from Union Camp Corporation of Dover, Ohio; Empol 1022, commercially available from Henkel Corporation of Cincinnati, Ohio; and Hystrene 3695, commercially available from Witco Co. of Memphis, Tenn.

In addition, blends of dimer and trimer acids can also be used as the lubricity additive of the present invention. These blends can be formed by combining dimer and trimer acids, or can comprise the reaction product from the formation of the dimer acid, which can contain substantial amounts of trimer acid. Generally, blends comprise about 5% to about 80% dimer acid. Specific blends include a blend of about 75% dimer acid and about 25% trimer acid, commercially available as Hystrene 3675, a blend of 40% dimer acid and 60% trimer acid, commercially available as Hystrene 5460, and a blend of about 60% dimer acid and about 40% trimer acid, all commercially available from Witco Co. of Memphis, Tenn.

Phosphate esters useful as the lubricity additive of the present invention can be prepared by phosphorylation of aliphatic and aromatic ethoxylates. These phosphate esters can be hydrophylic or lipophylic and include phosphate esters of fatty alcohol ethoxylates. Suitable phosphate esters are commercially available as Antara LB700, a hydrophylic phosphate ester and Antara LB400, a lipophylic phosphate ester, both of which are commercially available from Rhone-Poulenc Co. of Cranbury, N.J. The sulfurized castor oil which may be used in the present invention is commercially available as Actrasol C-75 from Climax Performance Materials Corporation Co. of Summit, Ill.

As noted above, the use of dimer or trimer acids is highly preferred as the lubricity additive of the present invention, as compared to phosphate esters or sulfurized castor oil. This is because the combustion of emulsions using the dimer and/or trimer acid lubricity additives produce less ash, with less than about 0.2% ash being highly preferred.

The lubricity agent provided in the noted emulsions should be present at a level which varies between about 50 and about 550 parts per million (ppm) in the emulsion. Most preferably, the lubricity additive is present at levels of about 100 to about 400 ppm. At these levels, emulsions of up to about 85% water-in-fuel oil or as low as about 15% fuel oil-in-water will exhibit lubricities comparable to those of fuel oil alone.

Most advantageously, when an emulsification system is employed to maintain emulsion stability, the lubricity agent is incorporated into the emulsification system and applied to the emulsion in this manner. The lubricity agent should be present in the emulsification system, which when applied at a level of about 1500 to about 3500 ppm, more advantageously about 2500 to about 3000 ppm, ensures the desired level of lubricity agent is present in the final emulsion.

Interestingly, the lubricity gains provided by the inventive lubricity additive are relatively specific to diesel fuel and water emulsions. In tests on fuel oil alone, and water alone, no significant increases in lubricity have been noted, yet incorporation of the inventive lubricity additives in a diesel fuel and water emulsion creates significant increases in the lubricity of the emulsion. In fact, when added to diesel fuel and water emulsions, the lubricity additives increase the emulsion lubricity to levels equivalent to those for fuel oil alone.

The emulsion of the present invention may also comprise a combustion catalyst such as compositions or complexes of cerium, platinum or a platinum group metal, copper, iron, or manganese. Such catalysts, especially when the composition comprises platinum or a platinum group metal, can be included in the emulsion at levels which can range from about 0.005 to about 1.0 parts per million (ppm), especially about 0.01 to about 0.5 ppm. Platinum group metals include platinum, palladium, rhodium, ruthenium, osmium, and iridium.

The combustion catalyst preferably comprises a water- or fuel-soluble platinum group metal composition. The composition should be temperature stable and should not contain a substantial amount of phosphorus, arsenic, antimony or halides. If fuel solubility is desired, the composition should be non-ionic and organic in nature. The nonionic, organic nature of the composition provides solubility in the fuel, thereby facilitating the introduction of the composition into the combustion chamber. Without such solubility, much of the combustion catalyst would precipitate in the fuel tank or fuel lines of the engine prior to introduction into the combustion chamber.

Since most feed lines for a diesel engine are designed with the intent that they be exposed only to an essentially non-aqueous environment, it is also desirable to incorporate a corrosion inhibitor with the lubricity additives of the present invention. Suitable corrosion preventing additives include filming amines, such as organic, ethoxylated amines. Among these are N,N',N'-tris(2-hydroxyethyl)-N-tallow-1, 3-diaminopropane, commercially available as Ethoduomeen T/13 from Akzo Chemicals, Incorporated of Chicago, Ill.; an oleic diethanolamide which is the reaction product of methyl oleate and diethanolamine; an alkanolamide commercially available as Mackamide MO from McIntyre Co. of Chicago, Ill.; and Ethoduomeen T/25, which is a higher ethoxylated version of Ethoduomeen T/13. Moreover, a biocidal agent can also be employed, to prevent biological contamination of the fuel and engine lines.

The appended drawing FIGURE illustrates a diesel engine vehicle fuel system 10 which makes use of a preferred embodiment of the present invention. As illustrated therein, water is provided from a suitable source tank 20 through line 22 to an in-line mixer 24 via a suitable pump (not shown). When the aqueous phase comprises water (and emulsifier) and catalyst composition, the catalyst composition is supplied from tank 26 through line or conduit 28 by the action of a suitable pump (not shown) to in-line mixer 24. The water is then directed via a pump (not shown) through line 32 to a mechanical emulsifier 30. Diesel fuel from a suitable source tank 40 is concurrently directed by the action of a pump (not shown) to emulsifier 30 through line 42 where the diesel fuel and water are emulsified together in the appropriate ratios.

After exiting from emulsifier 30 the diesel fuel emulsion is directed via line 52 to emulsion tank 50 via a suitable pump (not shown) from where it is fed by a pump (not shown) via line 62 to diesel tank 60 from where it is fed to the engine (not shown). In the alternative, the emulsion exiting from mechanical emulsifier 30 can be supplied via lines 52 and 72 to interim storage tank 70 where it is stored prior to combustion. The emulsion is then directed from storage tank 70 through line 74 to emulsion tank 50 and then to diesel tank 60.

In addition, in order to maintain emulsion stability, the emulsion from diesel engine 60 can be recirculated via recirculation line 80 to emulsion tank 50 and then back to diesel engine 60 via line 62. Thus, by use of the illustrated system, a diesel vehicle can be modified to prepare and combust an aqueous emulsion comprising a combustion catalyst in diesel fuel.

Although the precise reason for the degree of nitrogen oxides reductions achievable with the present invention is not fully understood, it is believed that the water component of the subject emulsion serves to reduce the peak flame temperature of combustion which limits overall $NO_x$ formation. The catalyst composition (when used) results in an increase in combustion efficiency (as well as an increase in horsepower and fuel economy, it is believed).

Accordingly, use of the inventive emulsion in the illustrated diesel engine fuel system leads to reduction of nitrogen oxides under conditions and to levels not before thought possible.

The following examples further illustrate and explain the invention, but are not considered limiting.

EXAMPLE 1

The lubricity of water and fuel oil emulsions is tested using a Falex Lubricant Tester. The procedure used is based on ASTM standard method D2670-88. In the test, steel 1037 alloy V-blocks are used with 5052 alloy aluminum test pins. Evaluations are performed in duplicate and average results reported. In the case of inconsistent results, a triplicate test is performed. Test pins are cleaned, weighed, and saved in plastic bags. Acceptable performance is defined as passing 500 psi pressure for 5 minutes.

The data is presented in terms of metal loss (grams/hour), total running time (seconds), and a Wear Index which provides wear increments at 250 psi, 500 psi, and 750 psi. The Wear Index is presented in the format A/B(B)/Cx, where A represents increments to maintain 250 psi, B represents total increments from beginning of test through 500 psi, (B) represents increments to maintain 500 psi, and C represents total increments from beginning of test to failure as marked by the x.

The individual runs made include

Controls

Run 1—#2 fuel oil.

Run 2—80% water-in-#2 fuel oil.

Run 3—70% water-in-#2 fuel oil.

Performance Tests

Run 4—70% water-in-#2 fuel oil, further containing 200 ppm of Westvaco Diacid 1550 dimer acid.

Run 5—80% water-in-#2 fuel oil, further containing 200 ppm Westvaco Diacid 1550 dimer acid.

Run 6—70% water-in-#2 fuel oil, further containing 200 ppm phosphate ester.

Run 7—70% water-in-#2 fuel oil, further containing 400 ppm of sulphurized castor oil.

Run 8—#2 fuel oil containing 200 ppm Westvaco Diacid 1550 dimer acid.

Run 9—water containing 200 ppm Westvaco Diacid 1550 dimer acid.

The results of these tests are set out in Table 1.

TABLE 1

| Run | Metal Loss (gm/hr) | Total Running Time (Seconds) | Cumulative Total (Maintenance) Increments through 250/500/750 psi (Index of Wear) |
|---|---|---|---|
| 1* | 0.52 | 678 | 20/271(124)351/x |
| 2 | 4.23 | 41 | 93x/—/— (Massive Failure) |
| 3 | | MASSIVE FAILURE | |
| 4 | 0.15 | 630 | 5/158(31)/305x |
| 5 | 0.20 | 621 | 12/165(32)/266x |
| 6 | 0.18 | 700 | 8/92(12)/360x |
| 7 | 0.15 | 630 | 9/152(35)/334x |
| 8 | 0.53 | 652 | 37/282(125)507x |
| 9 | | MASSIVE FAILURE | |

*Performance standard

EXAMPLE 2

The procedure of Example 1 is followed using an emulsion comprising 70% water in #2 fuel oil having lubricity additives set out below. The runs made are as follows:

Run 1—100% #2 fuel oil as control.

Run 2—200 ppm Westvaco Diacid 1550 dimer acid and 200 ppm Ethoduomeen T/13.

Run 3—400 ppm sulfurized castor oil and 400 ppm Ethoduomeen T/13.

Run 4—200 ppm of a blend of 40% dimer acid and 60% trimer acid, and 0.02% Ethoduomeen T/13.

Run 5—400 ppm Unidyme 12 dimer acid and 400 ppm Ethoduomeen T/13.

Run 6—200 ppm Antara LB400 lipophyllic phosphate ester.

Run 7—200 ppm of Hystrene 3675, a blend of 75% dimer acid and 25% trimer acid and 200 ppm Ethoduomeen T/13.

Run 8—400 ppm Westvaco Diacid 1550 dimer acid and 200 ppm Ethoduomeen T/13.

Run 9—400 ppm Unidyme 12 dimer acid and 400 ppm Ethoduomeen T/13.

Run 10—400 ppm Unidyme 12 dimer acid.

Run 11—500 ppm Antara LB700 hydrophyllic phosphate ester.

Run 12—400 ppm sulfurized castor oil and 200 ppm Ethoduomeen T/13.

Run 13—400 ppm Westvaco Diacid 1550 dimer acid.

Run 14—300 ppm of Hystrene 5460 a blend of 40% dimer acid and 60% trimer acid and 100 ppm Ethoduomeen T/13.

Run 15—400 ppm Westvaco Diacid 1550 dimer acid and 400 ppm Ethoduomeen T/13.

Run 16—400 ppm sulfurized castor oil.

Run 17—100 ppm of Hystrene 5460 trimer acid and 100 ppm Ethoduomeen T/13.

Run 18—200 ppm sulfurized castor oil and 200 ppm Ethoduomeen T/13.

Run 19—400 ppm sulfurized lard oil.

Run 20—400 ppm polyacrylic acid.

Run 21—800 ppm Ethoduomeen T/13.

Run 22—800 ppm Witcamide 511 alkanolamide.

Run 23—2000 ppm Witcamide 511.

Run 24—800 ppm Witconol 14 polyglycerol ester of oleic acid.

Run 25—800 ppm Duomeen C, N-coco-1,3-diaminopropane.

Run 26—800 ppm Polyamine HPA, a complex mixture of ethyleneamines commercially available from Union Carbide Co. of Danbury, Conn.

Run 27—400 ppm Duomeen C and 200 ppm Dowanol DB, diethyleneglycolmonobutylether.

Run 28—400 ppm ethoxylated castor oil.

Run 29—400 ppm Witcamide 511.

Run 30—400 ppm Ethoduomeen T/13.

Run 31—400 ppm Ethoduomeen T/25.

Run 32—400 ppm ethoxylated castor oil and 200 ppm Dowanol EB.

Run 33—400 ppm ethoxylated castor oil and 200 ppm #2 fuel oil.

Run 34—400 ppm ethoxylated castor oil, 400 ppm #2 fuel oil, and 400 ppm Dowanol EB, 2-butoxyethanol/ethyleneglycolbutylether.

Run 35—400 ppm Witcamide 511, 400 ppm #2 fuel oil, and 400 ppm Dowanol EB.

Run 36—400 ppm Ethoduomeen T/13, 400 ppm #2 fuel oil, and 400 ppm Dowanol EB.

Run 37—400 ppm Ethoduomeen T/25, 400 ppm #2 fuel oil, and 400 ppm Dowanol EB.

Run 38—400 ppm Ucon LB525 polypropylene glycol derivative of butanol.

Run 39—400 ppm Ucon EPML-X, metal working lubricant containing polyalkylene-glycol and diethanolamine, commercially available from Union Carbide Co. of Danbury, Conn.

Run 40—400 ppm Triton RW50 nitrogen containing surfactant, 400 ppm #2 fuel oil, and 400 ppm Dowanol EB.

The results are set out in Table 2.

TABLE 2

| Run | Average Metal Loss gm/hr | Average Total Running Time (seconds) | Average Cumulative Increments Through 250/500/750 psi |
|---|---|---|---|
| 1 | 0.52 | 678 | 20/271/351X |
| 2 | 0.15 | 630 | 5/158/305X |
| 3 | 0.15 | 634 | 9/152/334X |
| 4 | 0.16 | 680 | 8/152/300X |
| 5 | 0.17 | 634 | 5/148/315X |
| 6 | 0.18 | 743 (630) | 8/92/360(PF)*X |
| 7 | 0.18 | 628 | 4/152/282X |
| 8 | 0.19 | 672 | 5/155/450X |
| 9 | 0.19 | 642 | 11/150/340X |
| 10 | 0.21 | 825 | 5/152/572X |
| 11 | 0.21 | 625 | 49/229/391x |
| 12 | 0.21 | 592 (PF)* | 5/168X(PF)*/— |
| 13 | 0.23 | 669 | 8/162/380X |
| 14 | 0.26 | 627 | 9/162/285X |
| 15 | 0.27 | 630 | 12/200/352X |
| 16 | 0.38 | 665 | 12/202/428X |
| 17 | 0.46 | 514 (PF)* | 30/235(PF)310X |
| 18 | | MASSIVE FAILURE | |
| 19 | | MASSIVE FAILURE | |
| 20 | | MASSIVE FAILURE | |
| 21 | | MASSIVE FAILURE | |
| 22 | | MASSIVE FAILURE | |
| 23 | | MASSIVE FAILURE | |
| 24 | | MASSIVE FAILURE | |
| 25 | | MASSIVE FAILURE | |
| 26 | | MASSIVE FAILURE | |
| 27 | | MASSIVE FAILURE | |
| 28 | | MASSIVE FAILURE | |

TABLE 2-continued

| Run | Average Metal Loss gm/hr | Average Total Running Time (seconds) | Average Cumulative Increments Through 250/500/750 psi |
|---|---|---|---|
| 29 | | MASSIVE FAILURE | |
| 30 | | MASSIVE FAILURE | |
| 31 | | MASSIVE FAILURE | |
| 32 | | MASSIVE FAILURE | |
| 33 | | MASSIVE FAILURE | |
| 34 | | MASSIVE FAILURE | |
| 35 | | MASSIVE FAILURE | |
| 36 | | MASSIVE FAILURE | |
| 37 | | MASSIVE FAILURE | |
| 38 | | MASSIVE FAILURE | |
| 39 | | MASSIVE FAILURE | |
| 40 | | MASSIVE FAILURE | |

*PF = partial failure

It can be seen from the examples herein that the use of the inventive lubricity additives increase the lubricity of a water and fuel oil emulsion to levels approximating those for #2 fuel oil alone. In addition, compositions outside of the defined inventive compositions do not provide significant lubricity increases to a water and fuel oil emulsion, and typically result in massive failure. Interestingly, it can be seen that the addition of the inventive lubricity agents to #2 fuel oil or water alone does not have a substantial effect on the lubricity thereof, certainly not the same effect as the inventive lubricity additives have on a water and fuel oil emulsion.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention, which is defined by the following claims.

We claim:

1. An improved lubricity water and diesel fuel emulsion for use as fuel for a diesel engine, comprising a lubricity additive which comprises dimer acids, trimer acids or mixtures thereof.

2. The emulsion of claim 1, wherein said lubricity additive is present at a level of at least about 100 ppm.

3. The emulsion of claim 1, wherein said lubricity additive further comprises a corrosion inhibitor comprising a filming amine.

4. The emulsion of claim 1, which further comprises an emulsification system comprising:

a) about 25% to about 85% of an amide;

b) about 5% to about 25% of a phenolic surfactant; and c) about 0% to about 40% of a difunctional block polymer terminating in a primary hydroxyl group.

5. The emulsion of claim 4, wherein said amide comprises an alkanolamide formed by condensation of a hydroxyalkyl amine with an organic acid.

6. The emulsion of claim 4, wherein said phenolic surfactant comprises an ethoxylated alkylphenol.

7. The emulsion of claim 6, wherein said ethoxylated alkylphenol comprises ethylene oxide nonylphenyl.

8. The emulsion of claim 4, wherein said difunctional block polymer comprises propylene oxide/ethylene oxide block polymer.

9. The emulsion of claim 4, wherein said emulsification system is present in an amount of about 0.05% to about 5.0% by weight.

10. The emulsion of claim 1, which comprises up to about 70% water.

11. A method for reducing nitrogen oxides emissions from a diesel engine, comprising forming an emulsion of water and diesel fuel having up to about 70% water by weight, which comprises a lubricity additive comprising dimer acids, trimer acids, or mixtures thereof; and combusting said emulsion in a diesel engine.

12. The method of claim 11, wherein said lubricity additive is present at a level of at least about 100 ppm.

13. The method of claim 11, wherein said lubricity additive further comprises a corrosion inhibitor comprising a filming amine.

14. The method of claim 11, which further comprises an emulsification system comprising:

a) about 25% to about 85% of an amide;

b) about 5% to about 25% of a phenolic surfactant; and c) about 0% to about 40% of a difunctional block polymer terminating in a primary hydroxyl group.

15. The method of claim 14, wherein said amide comprises an alkanolamide formed by condensation of a hydroxyalkyl amine with an organic acid.

16. The method of claim 14, wherein said phenolic surfactant comprises an ethoxylated alkylphenol.

17. The method of claim 14, wherein said difunctional block polymer comprises propylene oxide/ethylene oxide block polymer.

18. The method of claim 14, wherein said emulsification system is present in an amount of about 0.05% to about 5.0% by weight.

19. The emulsion of claim 1, wherein the lubricity additive further comprises phosphate esters, sulfurized castor oil or mixtures thereof.

20. The method of claim 11, wherein said lubricity additive further comprises phosphate esters, sulfurized castor oil or mixtures thereof.

* * * * *